United States Patent [19]

Hall

[11] 4,372,193

[45] Feb. 8, 1983

[54] SYSTEM WITH CONSTANT FORCE ACTUATOR

[75] Inventor: Lowell R. Hall, Elmwood, Ill.

[73] Assignee: Caterpillar Tractor Co., Peoria, Ill.

[21] Appl. No.: 273,877

[22] PCT Filed: Dec. 24, 1980

[86] PCT No.: PCT/US80/01741

§ 371 Date: Dec. 24, 1980

§ 102(e) Date: Dec. 24, 1980

[87] PCT Pub. No.: WO82/02230

PCT Pub. Date: Jul. 8, 1982

[51] Int. Cl.[3] ..... F15B 11/10

[52] U.S. Cl. ..... 91/420; 91/433; 91/461; 91/517; 91/518; 137/596.13; 137/596.14; 91/516

[58] Field of Search ..... 91/420, 433, 461, 516, 91/517, 518; 137/596.13, 596.14, 625.63

[56] References Cited

U.S. PATENT DOCUMENTS

| | | | |
|---|---|---|---|
| 2,931,389 | 4/1960 | Modg, Jr. et al. | 91/433 |
| 3,720,059 | 3/1973 | Schurawski et al. | 91/532 X |
| 3,799,200 | 3/1974 | Tipton | 91/433 X |
| 3,927,603 | 12/1975 | Bernhoft | 91/412 |
| 3,994,325 | 11/1976 | Cryder et al. | 144/3 D |
| 4,041,983 | 8/1977 | Bianchetta | 137/625.63 |
| 4,230,022 | 10/1980 | Bianchetta et al. | 91/516 |

*Primary Examiner*—George L. Walton
*Attorney, Agent, or Firm*—J. W. Burrows

[57] ABSTRACT

A control mechanism (48) is provided to controllably maintain a constant force on an actuator (18) and provide fluid flow to a downstream control valve (24) by controlling a pilot differential pressure between first and second ends (38,40) of a pilot operated control valve (14). A two position valve (56,66) acting in response to a predetermined pressure level in the actuator (18) modulatably controls the flow of pressurized pilot fluid to the pilot operated control valve (14) to position the pilot operated control valve (14). This maintains the pressure in the actuator (18) at the predetermined pressure level and passes the excess flow of fluid from a source (12) to the downstream control valve (24).

7 Claims, 2 Drawing Figures

SYSTEM WITH CONSTANT FORCE ACTUATOR

DESCRIPTION

1. Technical Field

This invention is directed to pilot operated control valve systems and particularly those having an actuator requiring a continuous force on the actuator at the same time other work is being performed.

2. Background Art

Many systems use an accumulator to maintain a constant force on an actuator and thus allow the control valve to be returned to neutral. Even though these systems provide a constant force to the actuator, they are limited by the volume of the accumulator and the available space to locate the accumulator. Other systems use a feedback from the actuator to directly oppose the shifting force of the pilot pressure acting on the main control valve. These systems require additional components in the main control valve which adds complexity to the valve and does not allow the use of conventional available valves. Still others teach the use of reducing to a fixed level the pilot pressure to one end of the first valve in a priority system to allow the valve to attain some intermediate position in response to the actuation of the second valve. These systems will allow a constant force to the first actuator, however they do not allow the first valve total priority when the second valve is actuated.

The present invention is directed to overcoming one or more of the problems as set forth above.

DISCLOSURE OF THE INVENTION

In one aspect of the invention, a fluid system has a fluid source, an actuator, a tank and a pilot operated control valve. The pilot operated control valve has first and second ends and is movable between an actuated position and a neutral position. At the actuated position, the source communicates with the actuator and is blocked from a downstream control valve, and at the neutral position the fluid from the source is blocked from communication with the actuator and communicates with the downstream control valve through the pilot operated control valve. A pilot control valve is connected to a source of pressurized pilot fluid and the first and second ends of the pilot operated control valve. The pilot control valve is movable between a neutral position at which the source of pressurized pilot fluid is blocked from communication with the first and second ends, and an actuated position at which pressurized pilot fluid from the source is communicated with the first end establishing a differential pressure between the first and second ends. A means modulatably reduces the pilot differential pressure between the first and second ends of the pilot operated control valve at the actuated position of the pilot operated control valve in response to the fluid pressure in the actuator reaching a predetermined level, so that the pilot operated control valve is controllably moved between the neutral and actuated positions to maintain the predetermined pressure level in the actuator and to pass fluid to the downstream control valve.

BEST MODE FOR CARRYING OUT THE INVENTION

Figure 1:
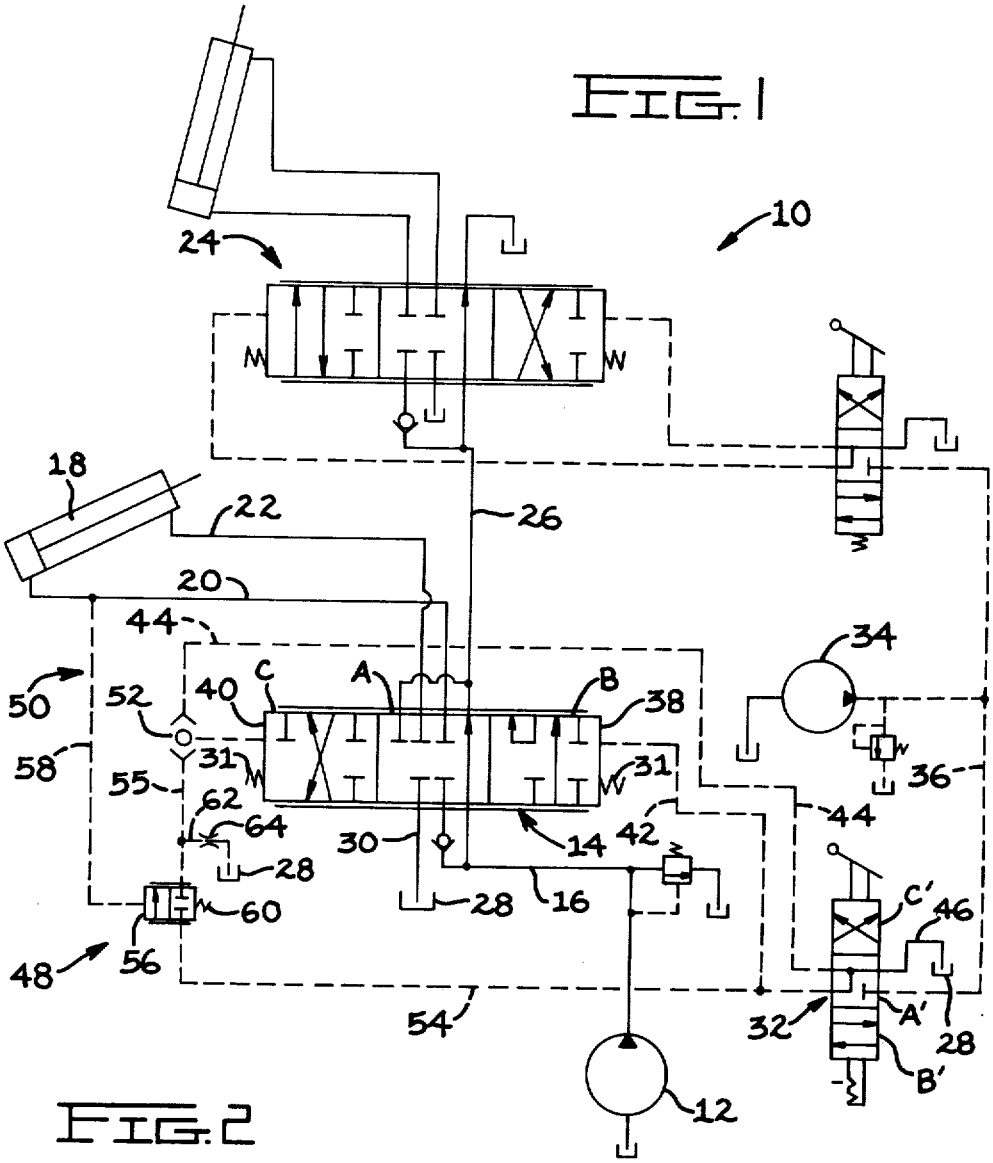
FIG. 1 is a schematic of an embodiment of the present invention.

Referring now to FIG. 1 a fluid system is generally indicated by reference numeral 10 and includes a fluid source, such as, a pump 12 and a pilot operated control valve 14 connected to the pump 12 by a conduit 16. An actuator 18 is connected to the pilot operated control valve 14 by a pair of conduits 20, 22. A control valve 24 is connected to the pilot operated control valve 14 by a conduit 26 and positioned downstream of the pilot operated control valve 14. A tank 28 is connected to the pilot operated control valve 14 by a conduit 30.

The pilot operated control valve 14 is movable between a first or neutral position "A", a second or actuated position "B" and a third position "C". The pilot operated control valve 14 is biased by centering springs 31 to the neutral position in a conventional manner. At the neutral position "A" the fluid source or pump 12 is blocked from communication with the actuator 18 and is in fluid communication with the downstream control valve 24. At the second or actuated position "B", the fluid source 12 is in communication with the actuator 18 through conduit 20 and the return flow in line 22 communicates with the control valve 24 through conduit 26. At the third position "C", the fluid source 12 is blocked from communication with the control valve 24 and is in communication with the actuator 28 through conduit 22. The return flow in conduit 20 from actuator 18 returns to tank 28 through conduit 30.

A pilot control valve 32 is connected to a source of pressurized pilot fluid, such as a pilot pump 34, by a conduit 36. The pilot control valve 32 is connected to first and second ends 38,40 of the pilot operated control valve 14 by first and second conduits 42,44 respectively. A conduit 46 connects the pilot control valve 32 to the tank 28.

The pilot control valve 32 is movable between a first or neutral position "A'", a second, detented or actuated position "B'" and a third position "C'". At the neutral position "A'", the first and second ends 38,40 of the pilot operated control valve 14 are blocked from communication with the source of pressurized pilot fluid 32 and are in communication with the tank 28. At the actuated position "B'", the first end 38 is in communication with the source 34 of pressurized pilot fluid, and the second end 40 is open to the tank 28. At the third position "C'", the second end 40 is in communication with the source 34 of pressurized pilot fluid and the first end 38 is open to the tank 28. At the second and third positions "B', C'", a differential pressure is established between the first and second ends 38,40 of the pilot operated control valve 14 by the difference in the pressures between the first and second ends 38,40.

A means 48 is provided for modulatably reducing the pilot differential pressure between the first and second ends 38,40 of the pilot operated control valve 14 in response to the fluid pressure in the actuator 18 reaching a predetermined level, so that the pilot operated control valve 14 is controllably moved between the neutral and actuated positions "A, B" to maintain the predetermined pressure level in the actuator 18 and to pass fluid to the downstream control valve 24.

The means 48 includes a two position valve 56 connected to the first end 38 and the actuator 18 and is adapted to controllably pass pressurized pilot fluid from the first end 38 in response to the actuator 18 reaching the predetermined level. The fluid from the two position valve 56 is directed to the second end 40 of the pilot operated control valve 14 as hereinafter described. The two position valve 56 is connected to the first end 38 by a conduit 54 and the first conduit 42. A signal conduit 58 connects the two position valve 56 to the actuator 18.

The two position valve 56 is movable between a first position, as shown, at which the flow of pressurized pilot fluid through the conduit 54 is blocked and a second position at which the flow of pressurized pilot fluid is communicated through the conduit 54. The two position valve 56 is biased to its first position by a spring 60 and to its second position in response to fluid pressure in the actuator 18 reaching a predetermined level.

The means 48 also includes a second means 50 for controllably communicating the pressurized pilot fluid to the second end 40. The second means 50 includes a resolver valve 52 located in the second conduit 44, a third conduit 55 connected to the two position valve 56 and the resolver valve 52. The resolver valve 52 is adapted to sense the higher of the pressurized pilot fluid in the second and third conduits 44,55 and deliver the higher pressure to the second end 40.

A conduit 62 having an orifice 64 located therein is connected to the third conduit 55 between the two position valve 56 and the resolver 52 and is connected to the tank 28.

Figure 2:
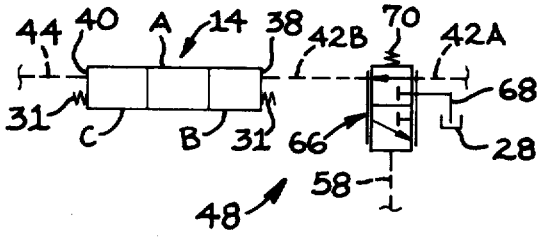
FIG. 2 is a schematic of a portion of FIG. 1 illustrating a second embodiment of the present invention.

Referring now to FIG. 2, a second embodiment is shown. It is noted that the same reference numerals of the first embodiment are used to designate similarly constructed counterpart elements of this embodiment. In this embodiment the resolver valve 52, the two position valve 56, conduit 54, third conduit 55, conduit 62 and orifice 64 are deleted. A two position valve 66 is connected to the pilot control valve 32 by conduit 42A and to the first end 38 of the pilot operated control valve 14 by a conduit 42B. The two position valve 66 is also connected to the tank 28 by a conduit 68 and to the actuator 18 by signal conduit 58. The two position valve 66 is movable between a first position, as shown, at which the presurized pilot fluid from the source 34 is directed to the first end 38, and a second position at which the pressurized pilot fluid is blocked from communication with the first end 38 and the first end 38 is communicated to the tank 28. The two position valve 66 is biased to the first position by a spring 70 and biased to the second position in response to fluid pressure in the actuator 18 reaching a predetermined level.

INDUSTRIAL APPLICABILITY

The present invention has particular utility in hydraulic systems that require having one actuator held under a constant force during operation of the system, such as, when lifting and/or transporting several logs in a log fork having clamping arms to hold the logs.

To hold the logs in a log fork, an operator moves the pilot control valve 32 to the second, detented position "B'" directing pressurized pilot fluid to the first end 38 of the pilot operated control valve 14 which establishes a differential pressure between the first and second ends 38,40, thus shifting the pilot operated control valve 14 to the second position "B". Fluid from the source 12 is directed to the actuator 18 by conduit 20 to close the clamping arms, not shown. The return flow by conduit 22 from the actuator 18 is passed to the downstream control valve 24 by line 26. Once the clamping arms, controlled by the actuator 18 clamps the logs, the pressure in the actuator 18 will increase. Upon the pressure in the actuator 18 reaching the predetermined pressure level, the two position valve 56, sensing the pressure through conduit 58, will move towards the second position against the bias of spring 60. The pressurized pilot fluid 34 from the first conduit 42 is modulatably directed through the two position valve 56 and the resolver valve 52 to the second end 40 of the pilot operated control valve 14. As the pressurized pilot fluid 34 is directed to the second end 40, the differential pressure between the first and second ends 38,40 is reduced. The centering springs 31 moves the pilot operated control valve 14 towards the neutral position "A" thus allowing fluid from the source 12 to pass to the downstream control valve 24. If the pressure in the actuator 18 falls below the predetermined level, the two position valve 56 moves towards the first position and reduces the flow of pressurized pilot fluid 34 to the second end 40. The pressurized fluid in the second end 40 is reduced by the flow of fluid across orifice 64 to tank 28. The higher pressure on the first end 38 moves the pilot operated control valve 14 towards the second position "B" to direct fluid from the source 12 to the actuator 18. The pilot operated control valve 14 will automatically move to a position to maintain the pressure in the actuator 18 at the predetermined pressure level until the pilot control valve 32 is returned to its neutral position "A'".

The second embodiment shown in FIG. 2 operates in a similar manner as the embodiment in FIG. 1 to automatically move the pilot operated control valve 14 to a position to maintain a predetermined pressure level in the actuator 18. In FIG. 2 the two position valve 66 modulatably controls, in response to the pressure in actuator 18, the pressurized pilot fluid acting on the first end 38. Once the predetermined pressure level in actuator 18 is reached, the two position valve sensing the pressure through conduit 58 moves towards the second position against the bias of spring 70. The force of the centering springs 31 acting against the reduced differential pressure moves the pilot operated control valve 14 towards the neutral position "A" as in FIG. 1.

With the addition of the means 48, an actuator can be maintained at a predetermined pressure while still providing flow to a downstream valve. In the event a high volume of fluid is needed in the actuator 18 due to shifting of the logs, the pilot operated control valve would automatically shift to its actuated position to supply the flow.

Other aspects, objects and advantages of this invention can be obtained from a study of the drawings, disclosure and appended claims.

I claim:

1. In a fluid system (10) having a fluid source (12); a tank (28); an actuator (18); a pilot operated control valve (14) having first and second ends (38,40) and movable between an actuated position (B) at which said source (12) communicates with said actuator (18) and is blocked from a downstream control valve (24), and a neutral position (A) at which fluid from said source (12) is blocked from communication with said actuator (18) and communicates with said downstream control valve (24) through said pilot operated control valve (14); a source (34) of pressurized pilot fluid; and a pilot control valve (32) connected to said source (34) of pressurized pilot fluid and said first and second ends (38,40) and movable between a neutral position (A') at which said source (34) of pressurized pilot fluid is blocked from communication with said first and second ends (38,40), and an actuated position (B') at which pressurized pilot fluid from said source (34) is communicated with the first end (38) establishing a differential pressure between the first and second ends (38,40); the improvement comprising:

means (48) for modulatably reducing the pilot differential pressure between the first and second ends (38,40) of the pilot operated control valve (14) only at the actuated position (B) of the pilot operated control valve (14) in response to the fluid pressure in said actuator (18) reaching a predetermined level while said pilot control valve (32) is still in said actuated position ($B^1$), so that said pilot operated control valve (14) is controllably moved between the neutral and actuated positions (A, B) to maintain said predetermined pressure level in said actuator (18) and to pass working fluid to the downstream control valve (24) and subsequently to said tank (28).

2. The fluid system (10), as set forth, in claim 1, wherein said means (48) includes a two position valve (56,66) connected to said first end (38) and said actuator (18) and adapted to controllably pass pressurized fluid from said first end (38) in response to said actuator (18) reaching the predetermined level.

3. The fluid system (10), as set forth in claim 2, wherein said means (48) includes a second means (50) for communicating said pressurized pilot fluid from said two position valve (56,66) to the second end (40).

4. The fluid system (10), as set forth in claim 3, including first and second conduits (42,44) respectively connecting said first and second ends (38,40) of the pilot operated control valve (14) to the pilot control valve (32);

said second means (50) includes a resolver valve (52) located in said second conduit (44), a third conduit (55) connected to said two position valve (56,66) and said resolver valve (52), said resolver valve (52) being adapted to sense the higher pressure of the pressurized pilot fluid in the second and third conduits (44,55) and deliver the higher pressure to the second end (40).

5. The fluid system (10) as set forth, in claim 4, wherein said means (48) includes a fourth conduit (54) connecting the first end (38) and the two position valve (56), said two position valve (56) being movable between a first position at which flow of said pressurized pilot fluid from said fourth conduit (54) to said third conduit (55) is blocked, and a second position at which the flow of pressurized fluid is open, said two position valve (56) being movable to the second position in response to said actuator (18) reaching the predetermined level.

6. The fluid system (10) as set forth in claim 2, wherein said two position valve (66) is movable between a first position at which said pressurized pilot fluid is directed to the first end (38) and a second position at which said pressurized pilot fluid is blocked from communication with said first end (38) and said first said end (38) is communicated to the tank (28), said two position valve (66) being movable to the second position in response to said actuator (18) reaching the predetermined level.

7. The fluid system (10) as set forth in claim 6, wherein said two position valve (66) is connected between the pilot control valve (32) and the first end (38) of the pilot operated control valve (14).

* * * * *